United States Patent [19]

Jensen et al.

[11] 4,223,707

[45] Sep. 23, 1980

[54] WOODSPLITTER UTILIZING SCREW MEMBER

[75] Inventors: Bruce W. Jensen; David L. Bacon, both of Denver, Colo.

[73] Assignees: Lawrence E. Livingston; Victoria A. Livingston, both of Englewood, Colo. ; part interest to each

[21] Appl. No.: 944,835

[22] Filed: Sep. 22, 1978

[51] Int. Cl.[3] ..... B27L 7/00

[52] U.S. Cl. ..... 144/193 R; 74/11; 74/63

[58] Field of Search ..... 144/3 K, 193 R, 193 A; 74/63, 11

[56] References Cited

U.S. PATENT DOCUMENTS

| | | | |
|---|---|---|---|
| 111,333 | 1/1871 | Ficht | 144/193 R |
| 1,283,195 | 10/1918 | Hunter | 144/193 R |
| 2,612,194 | 9/1952 | Ingraham et al. | 144/193 R |
| 4,121,636 | 10/1978 | James | 144/193 R |
| 4,133,359 | 1/1979 | Jensen et al. | 144/3 K |
| 4,141,395 | 2/1979 | Arzt | 144/3 K |

FOREIGN PATENT DOCUMENTS

| | | | |
|---|---|---|---|
| 231752 | 4/1944 | Switzerland | 144/193 R |

*Primary Examiner*—W. Donald Bray
*Attorney, Agent, or Firm*—O'Rourke & Harris

[57] ABSTRACT

Method and apparatus for splitting wood such as logs, comprising a prime mover selectively connectable to an elongated screw member to rotate the screw member in the clockwise direction and the counterclockwise direction, the screw member being mounted for rotation with a thrust bearing at one end of the screw member, an elongated bed structure, a trolley mounted for movement along the elongated bed structure, a nut having screw threads complementary to the screw member defined therethrough attached to the trolley and receiving and engaging the threads of the elongated screw member, and an abutment and a cutting blade, one of which is mounted to the trolley and the other of which is mounted to the bed structure adjacent the thrust bearing such that a log may be placed between the splitting blade and abutment and the blade urged into the log by moving the trolley towards the log by rotation of the screw member with the screw member being in tension during the splitting operation.

11 Claims, 4 Drawing Figures

WOODSPLITTER UTILIZING SCREW MEMBER

BACKGROUND OF THE INVENTION

1. Field of the Invention

The present invention relates generally to methods and apparatus for splitting wood, and more particularly to a method and apparatus for forcefully moving a trolley to urge a splitting blade into a length of wood, such as a log, with great force by means of rotation of a screw member operably connected to the trolley member by a nut threaded onto the screw member and secured to the trolley member, with the screw member being mounted for rotation in such a manner as to generate tension in the screw member during the splitting operation.

2. Description of the Prior Art

The need for power assisted log splitting equipment has long been realized. One of the more conventional configurations for serving this need involves equipment which urges a wedge through a log held by an abutment. A great number of designs have been proposed defining the means to apply sufficient force to a wedge shaped blade to cause the blade to penetrate the grain of wood, such as logs, to split such wood.

U.S. Pat. Nos. 3,077,214 and 3,242,955 are typical teachings of means by which a splitting wedge blade may be forced into a horizontally positioned log through hydraulic pressure generated by a pump and applied through a piston and cylinder arrangement. Although these designs provide both the power and control necessary to split logs, inclusion of a hydraulic system in the design render the devices somewhat complex and relatively expensive to manufacture in that larger power sources are required because of the inefficiency of hydraulic systems.

Several mechanically actuated, non-hydraulic wood splitting devices have been proposed. U.S. Reissue Pat. No. 13,221, for instance, discloses means by which a pitman arm is driven in reciprocating motion by rotating gears and alternatively providing a splitting and retracting motion through the blade. A similar teaching is found in U.S. Pat. No. 262,591 which discloses an analogous splitting movement but teaches the additional feature of an abutment having variable positioning by means of a screw thread.

A number of teachings utilizing screw threads to urge splitting blades through wood are also to be found. For instance, U.S. Pat. No. 111,333 discloses an arrangement in which a rotatably mounted screw engages an elongated nut which in turn is positioned and located to move a splitting blade as the screw is rotated. The screw, as it rotates to move the nut, is in compression thereby inducing a bending force in the screw and a splitting force acting on the nut. As a result, such screw members must be very sturdy with accompanying energy loses from friction resulting from such oversize dimensions.

U.S. Pat. No. 1,283,195 discloses another arrangement involving a screw member in which the driving nut is fixedly mounted with regard to axial movement. Thus the screw moves out of the nut urging a blade into an adjacent log. Again, the screw is in compression with a bending moment and, as a greater length of the screw member moves out of the nut, the stresses in the screw member increase thereby again mandating a very large, sturdy screw member.

U.S. Pat. No. 1,189,999 is subject to similar criticism as the worm drive urges the screw member into or against a log in a compression mode with substantial length of the screw member being unsupported against bending.

Thus, insofar as the above screw member and nut actuated devices are concerned, the splitting forces are opposed by screw members of brute dimensions to cope with such forces inducing compression and bending of the screw member. This increases the weight and lowers the efficiency of such designs.

SUMMARY OF THE INVENTION

The present invention, which provides a heretofore unavailable improvement over previous log splitting devices, comprises a method and apparatus for utilizing a rotatably mounted, elongated screw member to urge a cutting blade and abutment together to split logs or similar articles while maintaining the screw member in a tension mode during splitting. This permits use of substantially smaller and more efficient components than other designs in which the screw member is in a compression mode during the splitting step. The tension is induced by mounting one of a blade and abutment to a nut threaded onto the screw member and positioning an axial thrust bearing carrying the screw member adjacent the other of the blade and abutment so as to utilize the thrust bearing and screw member to pull the other member against the log. Preferably, the screw member is driven by a prime mover through alternatively selectable drive means with a greater mechanical advantage being employed to rotate the screw member while in the splitting mode and a lesser mechanical advantage being utilized to rotate the screw member during the retraction step.

Accordingly, an object of the present invention is to provide a new and improved apparatus for the splitting of wood such as logs, having as major features, simplicity of design, affordability, cost, ease of operation, high efficiency resulting from less massive components and an enhanced operation cycle period.

Another object of the present invention is to provide a new and improved method of applying rotary power from an engine to a rotating screw member such that the screw member is maintained under tension during the splitting steps.

Yet another object of the present invention is to provide a new and improved method of utilizing power from an engine to retract a linearly reciprocating trolley at a rate in excess of that at which the trolley performs the splitting stroke by driving an elongated screw member with a prime mover at differing mechanical advantages during the two movements to thereby abbreviate the cycling period of the apparatus without compromising the available force during the splitting step.

These and other objects and features of the present invention will become apparent from the following description.

DETAILED DESCRIPTION OF THE INVENTION

Figure 1:
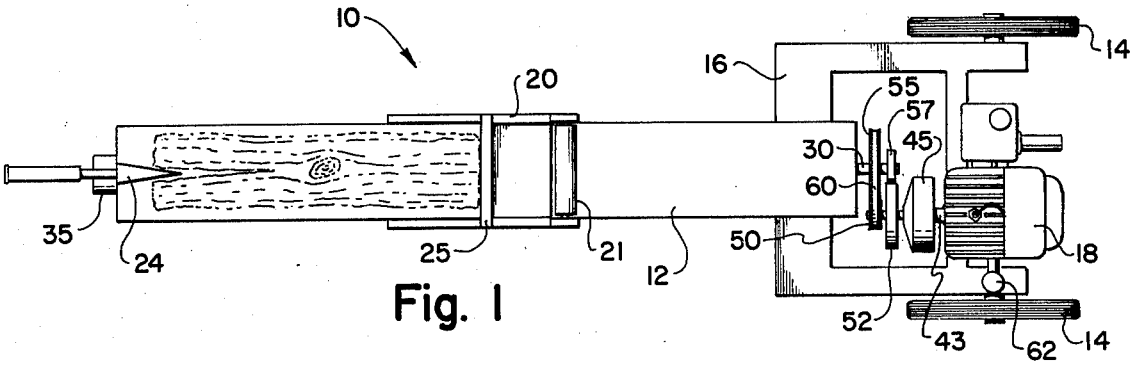
FIG. 1 is a top plan view of an apparatus in accord with the instant invention with a log illustrated in ghosted fashion.
Figure 2:
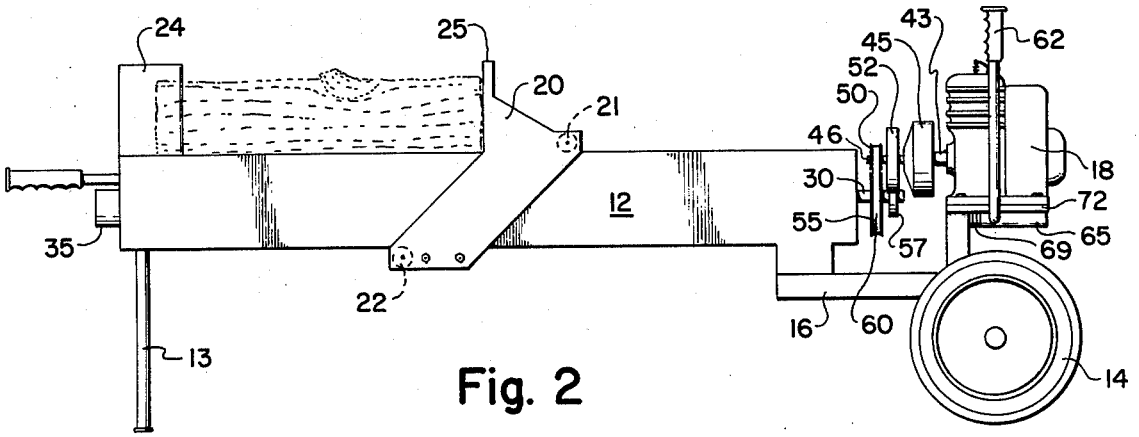
FIG. 2 is a frontal plan view of an apparatus as illustrated in FIG. 1.

Turning now to the drawings, wherein like components are designated by like reference numerals throughout the various Figures, an apparatus for splitting wood is illustrated in FIGS. 1 and 2 and generally designated by reference numeral 10. Wood splitter 10 includes a main horizontal bed 12 supported at a convenient height by front leg 13 and rear wheels 14 journaled to support assembly 16 which extends from bed structure 12 and carries prime mover 18. Trolley 20 is carried by upper roller 21 and lower roller 22 upon bed structure 12 for reciprocating linear movement thereupon. Splitting blade 24 is, as illustrated, fixedly attached to bed structure 12 while abutment 25 is carried upon trolley 20, though it is of course to be understood that the relationship of these cooperating members may be reversed, i.e., with the splitting blade carried on the trolley and the abutment fixed.

Figure 3:
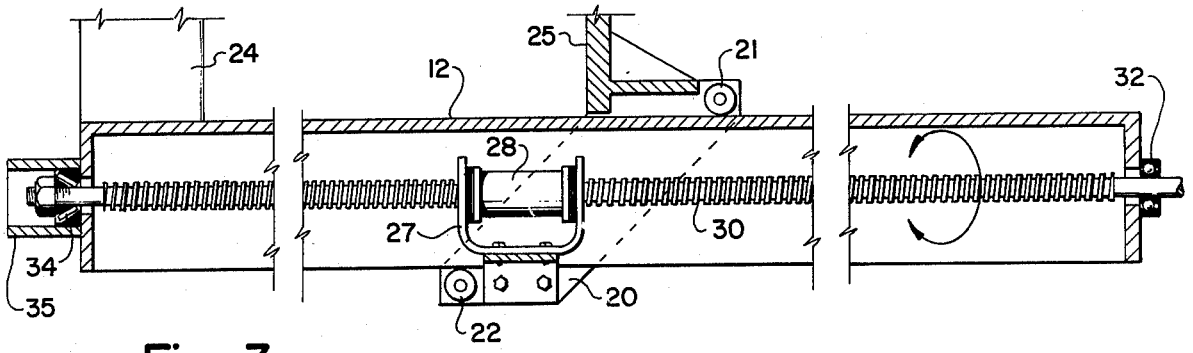
FIG. 3 is a more detailed sectioned view of a portion of the apparatus shown in FIG. 2.

As shown in FIG. 3, trolley 20 carries a yoke 27 which in turn is secured to nut 28. Nut 28 is internally threaded to engage the threads of screw member 30. While nut 28 may be fashioned of various materials, including metals, polymeric materials such as nylon are wear resistant and display inherent lubricity.

Screw member 30 is journaled to bed structure 12, as illustrated, at opposed ends thereof, by bearing 32 and thrust bearing 34 carried in housing 35. As illustrated, bearing 32 does not afford axial support to screw member 30, while thrust bearing 34 does provide axial support. Accordingly, when trolley 20 and attached abutment 25 are moved towards splitting blade 24 by rotation of screw member 30, a tension force is induced in screw member 30 between nut 28 and thrust bearing 34. This "pulling", as opposed to the more conventional "pushing", of abutment 25 by means of screw member 30 is an important feature of the instant invention. Screw member 30 may be of a much lighter construction in that the tension force is an inherently straightening force upon screw member 30. Thus, failure of screw member 30 would be by means of complete material failure. On the other hand, the compression force tends to bend and deform screw member 30 thereby providing a failure mode of elastic or yield deformation requiring much larger size and strength of screw member 30. While the thrust provision for the retraction step of abutment 25 is not shown, this may be provided by thrust bearing 34, since the retraction mode involves low forces and compressive forces of such magnitude are not objectionable in screw member 30. On the other hand, a one way thrust bearing may be incorporated with some slack at bearing 32. This is not a critical feature and may be readily accomodated by the skill of the art.

As illustrated, prime mover 18 in the form of internal combustion engine, is pivotally mounted to support assembly 16, as will be described in more detail below. Output shaft 43 of prime mover 18 is oriented in a direction parallel to that of bed structure 12 and, as illustrated, includes a speed reducer 45. Output shaft 46 of speed reducer 45 carries two drive members, V-belt pulley 50 and friction drive wheel 52. Threaded member 30 carries driven V-belt pulley 55 and driven wheel 57, which are radially offset but axially aligned with V-belt pulley 50 and drive wheel 52. V-belt 60 extends between V-belt pulleys 50 and 55. Drive wheel 52 and driven wheel 57 may advantageously carry a high friction, wear resistant material, on the periphery, such as rubber.

Figure 4:
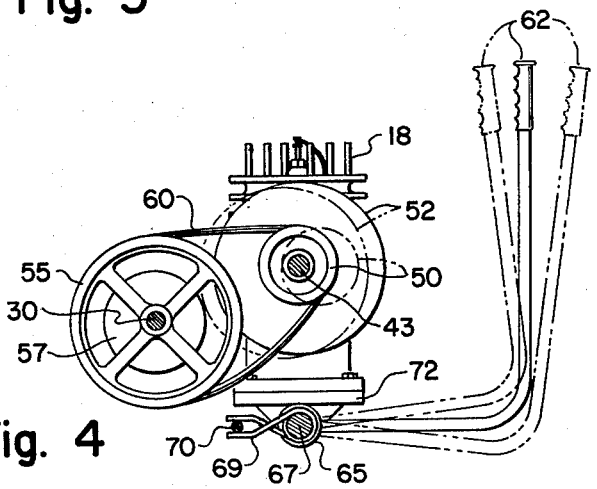
FIG. 4 is a simplified end view of the drive mechanism of the apparatus illustrated in the preceeding Figures.

Thus, in operation, prime mover 18 may, as shown in FIG. 4, be pivoted to either tension V-belt 60 between pulleys 50 and 55, or alternatively moved in the opposite direction to engage drive wheel 52 with driven wheel 57. With reference to FIG. 4, it will be appreciated that V-belt 60 will drive threaded member 30 in one rotational direction, while contact of drive wheel 50 and driven wheel 57 will rotate threaded member 30 in the opposite direction. Handle 62 is provided and attached to tubular bearing 65 which in turn is carried on shaft 67 secured to support assembly 16. Spring 69 is secured to tubular bearing 65 and biased towards a central position by limit member 70 which is also carried on support assembly 16. Plate 72, which carries prime mover 18, is in turn secured to tubular bearing 65. Thus, in operation, handle 62 is biased towards the central position shown in FIG. 4 at which position V-belt 60 is slack and drive wheels 52 and 57 are spaced apart. However, when spring 69 is distended by urging handle 62 to the right hand ghosted position, prime mover 18 rotates around shaft 67 until V-belt pulley 50 reaches the ghosted position at which point V-belt 60 is under tension thereby driving V-belt pulley 55. This causes screw member 30 to rotate and move abutment 25 towards blade 24.

On the other hand, when handle 62 is moved to the ghosted position shown on the left in FIG. 4, prime mover 18 moves around shaft 67 in an opposite sense thereby causing drive wheel 52 to engage driven wheel 57 thereby rotating screw member in the direction which withdraws abutment 25 from blade 64. As will be apparent, V-belt pulley 50 is substantially smaller than V-belt pulley 55. Thus substantial mechanical advantage is preferably provided when screw member 30 is driven in the splitting mode. On the other hand, drive wheel 52 is substantially larger than driven wheel 57 thereby providing for a more rapid retraction rate of trolley 20 in the withdrawal mode than in the splitting mode assuming a constant speed of prime mover 18.

In summary, by providing a simple, relatively small screw member which is utilized in a tension mode and with greater mechanical advantage relative to the prime mover during splitting, powerful and efficient splitting of wood and similar substances may be accomplished with a mechanically simple, relatively light-weight and low powered device. In the preferred embodiment, the drive system is a simple centrally biased pivotal arrangement of the drive mover yet conveniently and efficiently provides for differing mechanical advantages in the splitting mode and the retraction mode.

Although only a preferred embodiment of the invention has been illustrated and described, it is anticipated that various changes and modifications will be apparent to those skilled in the art and that such changes may be made without departing from the scope of the invention as defined by the following claims.

What is claimed is:

1. Apparatus for splitting articles, the apparatus comprising:

an elongated bed structure;

a trolley mounted for movement along the length of the bed structure;

an abutment;

a splitting blade, one of the abutment and the splitting blade being mounted on the trolley and the other being fixedly mounted relative to the bed structure;

a nut member having female threads defined therethrough and being attached to the trolley;

an elongated screw member rotatably mounted and extending in a direction parallel to the length of the elongated bed, the screw member engaging the threads of the nut member;

thrust means for axially locating the screw member, the thrust means being positioned at a portion of the screw member positioned more closely to the fixedly mounted of the splitting blade and abutment than to the other of the splitting blade and abutment mounted on the trolley;

a prime mover; and drive means operably connecting the prime mover to the screw member, the drive means comprise a drive V-belt pulley and a drive wheel coaxially mounted at the output of the prime mover and axially spaced therealong, a driven V-belt pulley and a driven wheel coaxially mounted at an end of the screw member and axially spaced therealong with the driven V-belt pulley and drive V-belt pulley being mutually radially spaced but axially aligned, and the driven wheel and drive wheel being mutually radially spaced but axially aligned, centrally biased pivotal mounting means for the prime mover mounting the prime mover for rotational movement around an axis substantially parallel to the prime mover output shaft and resiliently biased to a neutral position, and a V-belt connecting the drive V-pulley and the driven V-belt pulley, whereby the prime mover may be rotated to engage, selectively, the driven wheel and drive wheel, or selectively rotated to tension the V-belt, to thus rotate the screw member in the first rotational direction or the second rotational direction, or positioned in the neutral position at which neither the pulleys nor the wheels are engaged.

2. Apparatus for splitting articles as set forth in claim 1 in which the drive means includes a greater mechanical advantage in the portion thereof rotating the screw member in the first rotational direction and a lesser mechanical advantage in the portion thereof rotating the screw member in the second rotational direction.

3. Apparatus for splitting articles as set forth in claim 1 in which the nut member is formed of a polymeric material.

4. Apparatus for splitting articles as set forth in claim 1 in which the bed structure is in the form of a box member enclosed on at least three sides including the upper side, the screw member is rotatably mounted within the boxed member and the thrust means located at an end of the boxed member adjacent the fixedly mounted of the splitting blade and abutment.

5. Apparatus for splitting articles as set forth in claim 1 in which a speed reducer is provided between the prime mover and output shaft carrying drive wheel and drive V-belt pulley.

6. Apparatus for splitting articles as set forth in claim 1 in which the drive wheel is of a greater diameter than the driven wheel and the drive V-belt pulley is of a smaller diameter than the driven V-belt pulley.

7. Apparatus for splitting articles as set forth in claim 1 in which the prime mover is an internal combustion engine.

8. Apparatus for splitting wood, the apparatus comprising:

an elongated bed structure in the form of a boxed member enclosed on at least three sides including the upper surface;

a trolley movably mounted on the bed structure for movement along the length thereof;

an abutment;

a splitting blade, one of the abutment and the splitting blade being mounted on the trolley and the other being fixedly mounted relative to the bed structure;

an elongated screw member having male screw threads defined thereon rotatably mounted along the length of the bed structure and within the boxed member;

thrust means connecting the screw member to the bed structure at the end thereof adjacent the fixedly mounted of the abutment and splitting blade;

a nut member attached to the trolley and having female threads defined internally therethrough and engaging the threads of the screw member;

a primer mover;

mounting means securing the prime mover for pivotal movement around an axis parallel to the screw member;

biasing means mounted to urge the prime mover and mounting means to a predetermined neutral position;

a driven V-belt pulley secured to the screw member;

a drive V-belt pulley operably connected to the prime mover and radially spaced from but axially aligned with the driven V-belt pulley;

a V-belt engaging both the drive V-belt pulley and driven V-belt pulley;

a driven wheel secured to the screw member;

a drive wheel operably mounted to the prime mover and radially spaced from but axially aligned with the driven wheel;

and handle means connected to the prime mover and mounting means;

whereby the handle may be employed to urge the prime mover into a first position distinct from the neutral position at which the V-belt is tensioned to enable the drive V-belt pulley to rotate the driven V-belt pulley, or to urge the prime mover and mounting means to a second position distinct from the first position and neutral position at which the drive wheel engages the driven wheel to rotate the screw member in the opposite direction of rotation as that of the first position.

9. Apparatus for splitting articles as set forth in claim 7 in which the drive V-belt pulley is of a smaller diameter than the driven V-belt pulley and the drive wheel is of a larger diameter than the driven wheel.

10. Apparatus for splitting wood as set forth in claim 7 in which the prime mover is an internal combustion engine.

11. Apparatus for splitting wood as set forth in claim 8 in which the biasing means is a spring member bearing upon the pivotal mounting means to resiliently urge the pivotal mounting means and prime mover into the neutral position.

* * * * *